US008246030B2

(12) United States Patent
Sekine

(10) Patent No.: US 8,246,030 B2
(45) Date of Patent: Aug. 21, 2012

(54) SHEET FOLDING APPARATUS AND IMAGE FORMING SYSTEM

(75) Inventor: Noriaki Sekine, Saitama (JP)

(73) Assignee: Ricoh Company, Limited, Tokyo (JP)

( * ) Notice: Subject to any disclaimer, the term of this patent is extended or adjusted under 35 U.S.C. 154(b) by 570 days.

(21) Appl. No.: 12/458,499

(22) Filed: Jul. 14, 2009

(65) Prior Publication Data

US 2010/0013139 A1 Jan. 21, 2010

(30) Foreign Application Priority Data

Jul. 15, 2008 (JP) ..... 2008-183378
Mar. 5, 2009 (JP) ..... 2009-051469

(51) Int. Cl.
*B41F 13/64* (2006.01)
*B65H 29/00* (2006.01)

(52) U.S. Cl. ..... 270/16; 270/20.1; 399/407; 271/279

(58) Field of Classification Search ..... 399/407, 399/408; 493/434, 435, 442, 443, 444, 446, 493/447; 271/279, 302, 303; 270/4, 6, 8, 270/16, 20.1
See application file for complete search history.

(56) References Cited

U.S. PATENT DOCUMENTS 6,006,065 A * 12/1999 Seki ..... 399/407
7,470,227 B2 12/2008 Sekine et al.
7,503,886 B2 3/2009 Sekine et al.
7,631,866 B2 * 12/2009 Otomo et al. ..... 271/225
7,775,510 B2 * 8/2010 Yamamura et al. ..... 270/39.01

FOREIGN PATENT DOCUMENTS

JP HEI05-238639 A 9/1993
JP P 3577894 B2 7/2004
JP 2007-246228 A 9/2007

OTHER PUBLICATIONS

English machine translation of JP 2007-246228, Sep. 2007.*
Abstract of JP HEI11-011783, Jan. 19, 1999.

* cited by examiner

*Primary Examiner* — Ren Yan
(74) *Attorney, Agent, or Firm* — Harness, Dickey & Pierce, P.L.C.

(57) ABSTRACT

A sheet folding apparatus includes a first folding unit that folds a sheet of recording medium along first folds that extend orthogonal to a sheet conveying direction, a second folding unit that folds the sheet along a second fold that extends orthogonal to the first fold, a folded-sheet conveying unit that conveys the sheet folded by the first folding unit to the second folding unit, and a stacker unit. The stacker unit is arranged above the folded-sheet conveying unit. The sheet folding apparatus has a first exit through which a non-folded sheet is output, a second exit through which a fan-folded sheet is output, and a third exit through which a cross-folded sheet is output. Sheets output from the first exit and the second exit are stacked in the stacker unit.

11 Claims, 7 Drawing Sheets

SHEET FOLDING APPARATUS AND IMAGE FORMING SYSTEM

CROSS-REFERENCE TO RELATED APPLICATIONS

The present application claims priority to and incorporates by reference the entire contents of Japanese priority document 2008-183378 filed in Japan on Jul. 15, 2008 and Japanese priority document 2009-051469 filed in Japan on Mar. 5, 2009

BACKGROUND OF THE INVENTION

1. Field of the Invention

The present invention relates to a sheet folding apparatus that can be used as a peripheral device of an image forming apparatus.

2. Description of the Related Art

Sheet folding apparatuses are sometimes connected to copying machines (image forming apparatuses). For example, Japanese Patent Application Laid-open No. 2007-246228 discloses a sheet processing apparatus that takes in a sheet from a copying machine, folds the sheet, and delivers the folded sheet onto one of a plurality of stacker units. A sheet is sorted and delivered onto an appropriate stacker unit depending on how the sheet is folded, i.e., type and number of folds. Depending on the requirement, a sheet can be delivered without folding.

However, where a non-folded sheet is delivered is not specifically disclosed in Japanese Patent Application Laid-open No. 2007-246228. One approach could be to provide an additional stacker unit to stack non-folded sheets; however, this configuration is disadvantageous in requiring a larger space for the sheet processing apparatus.

SUMMARY OF THE INVENTION

It is an object of the present invention to at least partially solve the problems in the conventional technology.

According to an aspect of the present invention there is provided a sheet folding apparatus for use in folding a sheet of recording medium. The sheet folding apparatus includes a first folding unit configured to fold a sheet along at least one first fold that extends orthogonal to a direction of conveyance of the sheet; a second folding unit configured to fold a sheet along at least one second fold that extends orthogonal to the first fold; a first exit configured to output a sheet having not folded by any one of the first folding unit and the second folding unit; a second exit configured to output a sheet folded by the first folding unit; a third exit configured to output a sheet folded by the first folding unit and the second folding unit; a folded-sheet conveying unit configured to convey a sheet folded by the first folding unit to the second folding unit; and a first stacker unit in which sheets are to be stacked, the first stacker unit being arranged above the folded-sheet conveying unit, wherein the sheet output from the first exit is stacked in the first stacker unit.

According to another aspect of the present invention there is provided an image forming system comprising an image forming apparatus configured to form an image on a sheet of recording medium; and a sheet folding apparatus configured to receive the sheet and fold the sheet. The sheet folding apparatus including a first folding unit configured to fold a sheet along at least one first fold that extends orthogonal to a direction of conveyance of the sheet; a second folding unit configured to fold a sheet along at least one second fold that extends orthogonal to the first fold; a first exit configured to output a sheet having not folded by any one of the first folding unit and the second folding unit; a second exit configured to output a sheet folded by the first folding unit; a third exit configured to output a sheet folded by the first folding unit and the second folding unit; a folded-sheet conveying unit configured to convey a sheet folded by the first folding unit to the second folding unit; and a first stacker unit in which sheets are to be stacked, the first stacker unit being arranged above the folded-sheet conveying unit, wherein the sheet output from the first exit is stacked in the first stacker unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings.

An image forming system 100 according to a first embodiment of the present invention will be described with reference to FIGS. 1 through 5. While the image forming system 100 shown in FIG. 2 includes an external tray 65, the image forming system 100 shown in FIG. 3 includes a turnover-and-delivery unit 18 in place of the external tray 65. The turnover-and-delivery unit 18 turns over a long sheet while delivering the long sheet.

Figure 1:
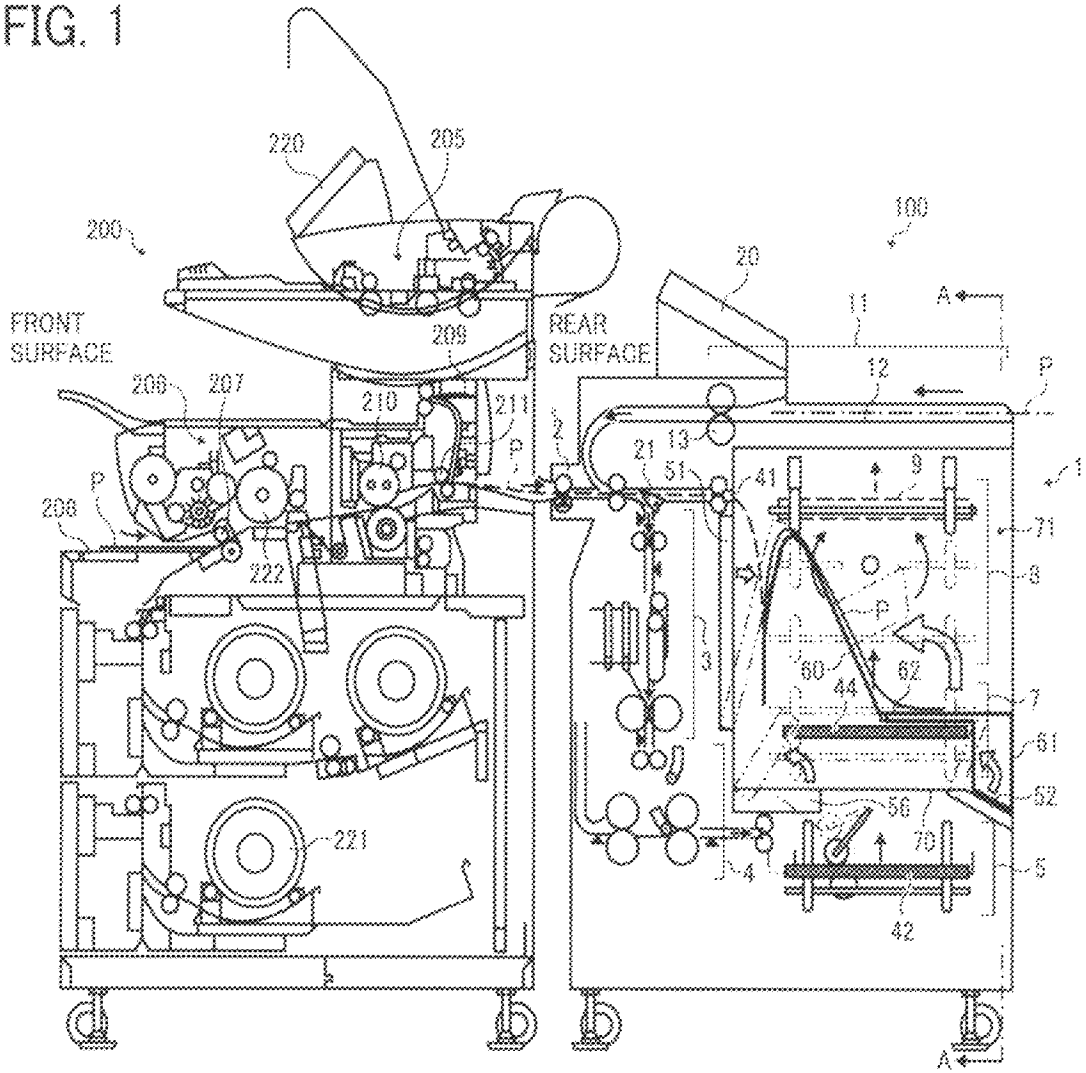
FIG. 1 is a schematic side view of an internal configuration of an image forming system according to embodiments of the present invention.

As depicted in FIG. 1, the image forming system 100 includes an image forming apparatus 200 and a sheet folding apparatus 1. The sheet folding apparatus 1 is connected to the image forming apparatus 200. The image forming apparatus 200 forms an image on a sheet of recording medium and conveys the sheet to the sheet folding apparatus 1. Concurrent with conveying the sheet to the sheet folding apparatus 1, the image forming apparatus 200 sends various data, such as a sheet size, a fold pattern, and parameters related to a fold type, to the sheet folding apparatus 1 via a serial cable. The sheet folding apparatus 1 receives the sheet from the image forming apparatus 200, and based on the data received from the image forming apparatus 200 folds, or does not fold, the sheet.

A wide roll (sheet) 221 of recording medium is housed in the image forming apparatus 200. Upon receipt of a request for forming an image on a large size sheet, the image forming apparatus 200 cuts the roll 221 according to data indicative of a size of an original and a size of a printout, thereby obtaining a cut sheet. The image forming apparatus 200 feeds the cut sheet to an image transfer unit, such as a photosensitive element 222, so that an image is transferred onto the cut sheet. The image is fixed onto the large size sheet by a fixing device 210. Examples of the roll 221 include a roll of tracing paper and a roll of transparency. A plurality of rolls 221 can be set in the image forming apparatus 200. Although not depicted in the drawings, the image forming apparatus 200 includes a sheet pulling unit that pulls a sheet from the roll 221, a sheet cutter that cuts the sheet at a specified position, and the image transfer unit arranged in this order. The image forming apparatus 200 cuts a sheet from the roll 221 and performs image forming operation automatically. The cut size of the sheet is determined based on a detected size of an original and the like.

On the other hand, the sheet folding apparatus 1 includes a connecting unit 2, a path switching flap 21, a corner folding unit 3, a fan folding unit (first folding unit) 4, a conveying-direction switching unit (folded-sheet conveying unit) 5, a cross folding unit (second folding unit) 6, a turnover unit 7, a rotation unit 8, a stamp unit 40, and a sheet delivery unit 30. The connecting unit 2 is a first sheet inlet port for taking in a sheet of recording medium from the image forming apparatus 200 in an online mode. The path switching flap 21 switches a sheet conveying path depending on whether the sheet is to be folded or not folded. The corner folding unit 3 folds a corner of the leading end of the sheet. The fan folding unit 4 folds a sheet along first folds that extend orthogonal to a direction, in which the sheet P is conveyed (hereinafter, "sheet conveying direction"), into a fan-like shape. The conveying-direction switching unit 5 switches a sheet conveying direction of the fan-folded sheet. The cross folding unit 6 receives the fan-folded sheet from the conveying-direction switching unit 5 and folds the sheet along a second fold that extends orthogonal to the first folds into one of regular sizes. The turnover unit 7 turns over (upside down) the folded sheet. The rotation unit 8 rotates the sheet by an appropriate angle. The stamp unit 40 performs ink stamping on the folded sheet. The sheet delivery unit 30 turns over the sheet and delivers the sheet onto a tray 9.

The sheet folding apparatus 1 includes a manual feed unit 11 as depicted in FIG. 1. The manual feed unit 11 is a second sheet inlet port for use in an offline mode. The manual feed unit 11 includes a manual feed table 12. A sheet can be fed to the sheet folding apparatus 1 by placing the sheet on the manual feed table 12 rather than receiving a sheet from the image forming apparatus 200.

A stacker unit 71 is arranged below the manual feed table 12 as depicted in FIG. 1. The stacker unit 71 has a first exit (non-folded sheet exit) 41 and a plurality of stackers 60. The first exit 41 is defined in a first side wall of the stacker unit 71. The stackers 60, on which non-folded sheets are to be stacked, are arranged below the first exit 41.

Figure 3:
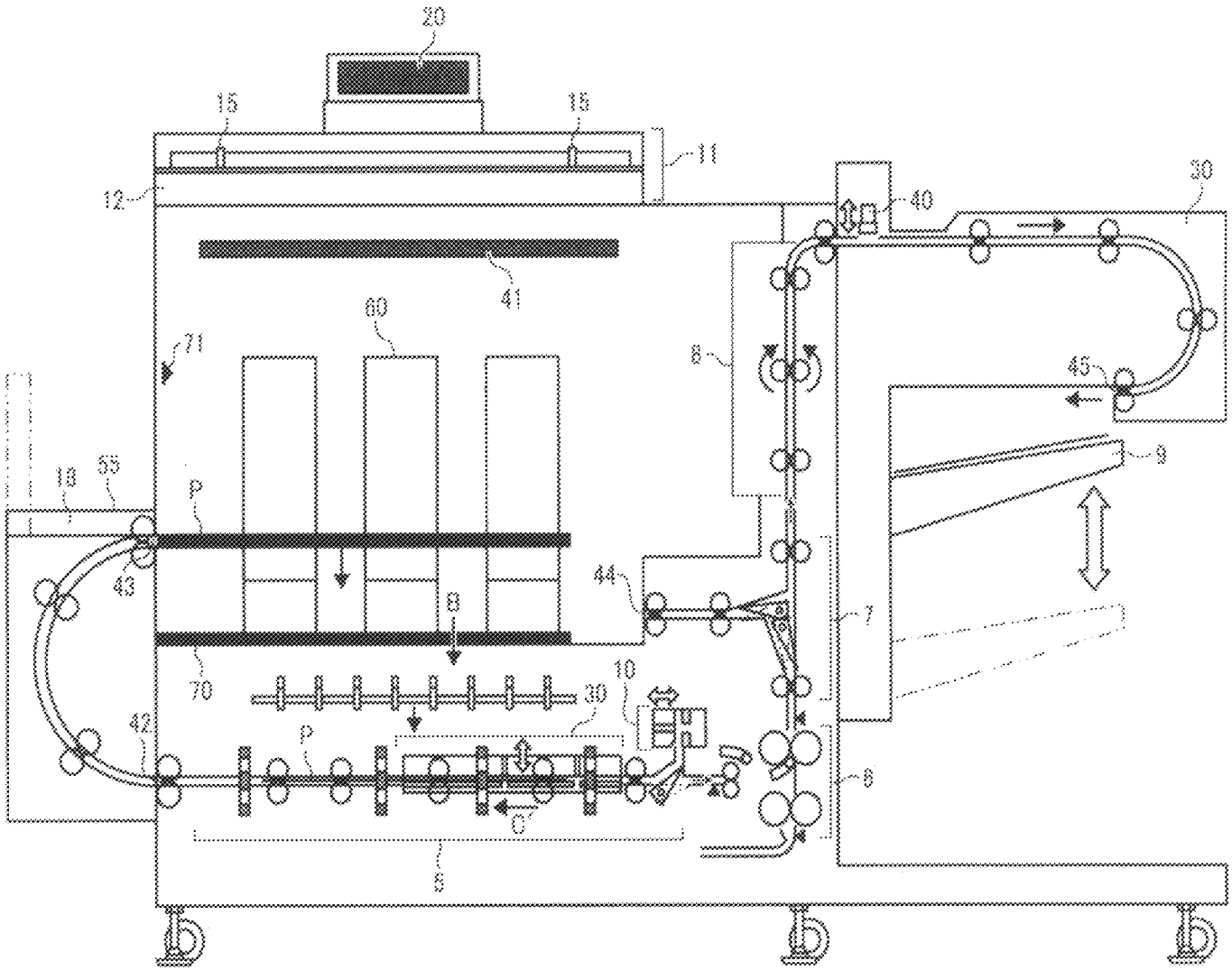
FIG. 3 depicts the internal configuration of the image forming system of FIG. 2 without cover doors to explain how a folded sheet is stacked in a stacker unit.

As depicted in FIG. 3, the sheet folding apparatus 1 also includes the turnover-and-delivery unit 18 on a side opposite from the cross folding unit 6 relative to the conveying-direction switching unit 5. The turnover-and-delivery unit 18 turns over a sheet having been fan-folded by the fan folding unit 4 and delivers the sheet onto a top surface 70 of the conveying-direction switching unit 5.

Figure 7A:
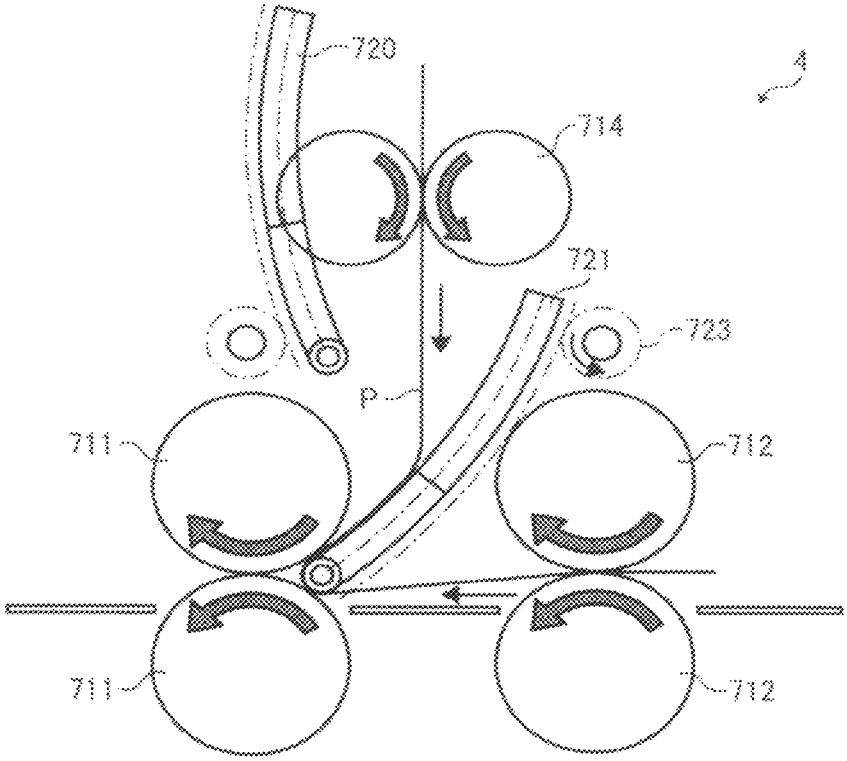
FIGS. 7A and 7B are schematic diagrams for explaining how a first folding unit performs fan folding.
Figure 7B:
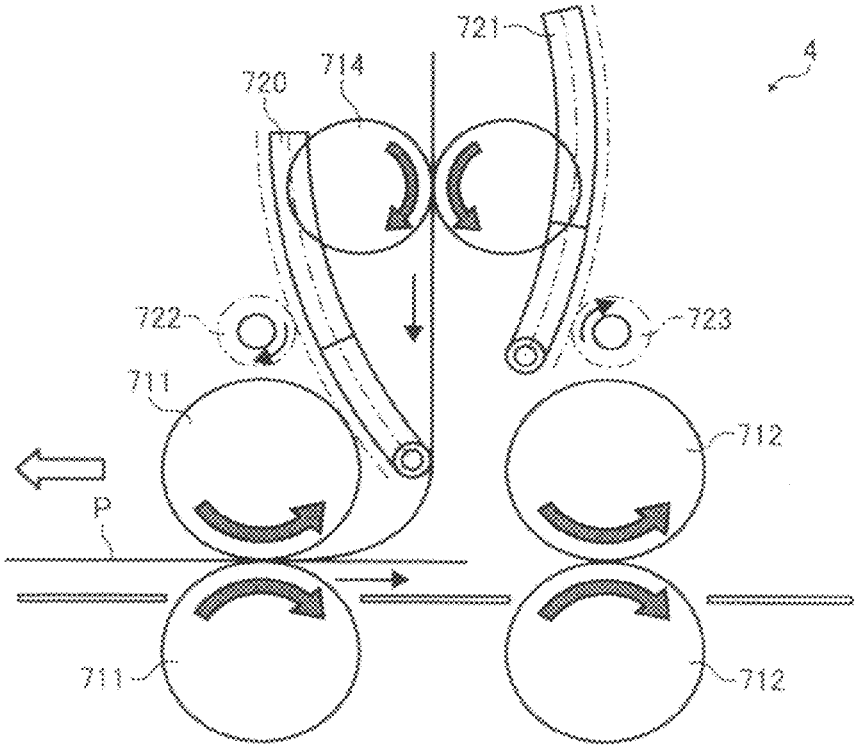

The configuration and operation of the fan folding unit 4 will be described with reference to FIGS. 7A and 7B. A pair of delivery rollers 714 feed a sheet to the fan folding unit 4. The delivery rollers 714 are arranged between directing members 720 and 721. The directing members 720 and 721 guide a sheet such that the sheet is directed to one of a pair of folding rollers 711 and a pair of folding rollers 712. Each of the directing members 720 and 721 moves along an arc trajectory that brings the directing members 720 or 721 into contact with a corresponding one of lower rollers of the folding rollers 711 or 712. The directing member 720 and 721 are moved toward or away from the sheet with the rotation of the drive gears 722 and 723. The leading end of the sheet is guided in this manner to advance into one of a nip between the folding rollers 711 and a nip between the folding rollers 712. One of the nips to which the leading end of the sheet is guided is selected by selecting one of the directing members 720 and 721 that is to be moved. In this example, the directing member 720 guides a leading end of a sheet to the folding rollers 712 on the right side in FIGS. 7A and 7B while the directing member 721 guides a leading end of a sheet to the folding rollers 711 on the left side. While the sheet is being folded, the directing member 720 or 721 guides an inner side of the sheet to one of the nips between the folding rollers 711 and 712.

By alternately moving the directing members 720 and 721 toward or away from the nips between the folding rollers 711 and 712, the sheet is guided to the nips alternately. As a result, the sheet is folded into a fan-like shape.

The stacker unit 71 will be described below. The stacker unit 71 is a storage space between the top surface 70 of the conveying-direction switching unit (folded-sheet conveying unit) 5 and the manual feed unit 11. Non-folded sheets and folded sheets can be stacked in the stacker unit 71. The stacker unit 71 receives sheets output through the first exit 41, a fourth exit 44, and a fifth exit 43. A non-folded sheet is output to the stacker unit 71 through the first exit 41. A sheet folded by the fan folding unit (first folding unit) 4 and the cross folding unit (second folding unit) 6 is output to the stacker unit 71 through the fourth exit 44. A sheet folded only by the fan folding unit 4 and then turned over is output to the stacker unit 71 through the fifth exit 43. The first exit 41 is defined in an upper portion of the first side wall of the stacker unit 71. The first side wall is between a second side wall and a third side wall, each of which forms a right angle with the first side wall. The fourth exit 44 and the fifth exit 43 are defined in the second side wall and the third side wall, respectively, at positions where the fourth exit 44 and the fifth exit 43 face each other. The fourth exit 44 also has a function of reversing the sheet conveying direction.

The stackers 60 in the stacker unit 71 are aligned with a certain gap therebetween. Each of the stackers 60 substantially has the shape of an inverted alphabet V so that a long, non-folded sheet can be laid and stacked on the stackers 60 (hereinafter, "stacker set 60").

Inputs for the online mode are entered from a first operation input unit 220 while inputs for the offline mode are entered from a second operation input unit 20. In the online mode, a sheet of recording medium on which an image has been transferred in the image forming apparatus 200 is fed to the sheet folding apparatus 1 to be folded.

In the offline mode, a sheet is fed by using the manual feed unit 11 to the sheet folding apparatus 1 and folded therein without passing through the image forming apparatus 200.

A typical example of the image forming apparatus 200 is an electro-photographic image forming apparatus; however, not limited to an electro-photographic image forming apparatus.

The image forming apparatus 200 can be an image forming apparatus of another known type, such as an inkjet type or a thermal transfer type.

Figure 4:
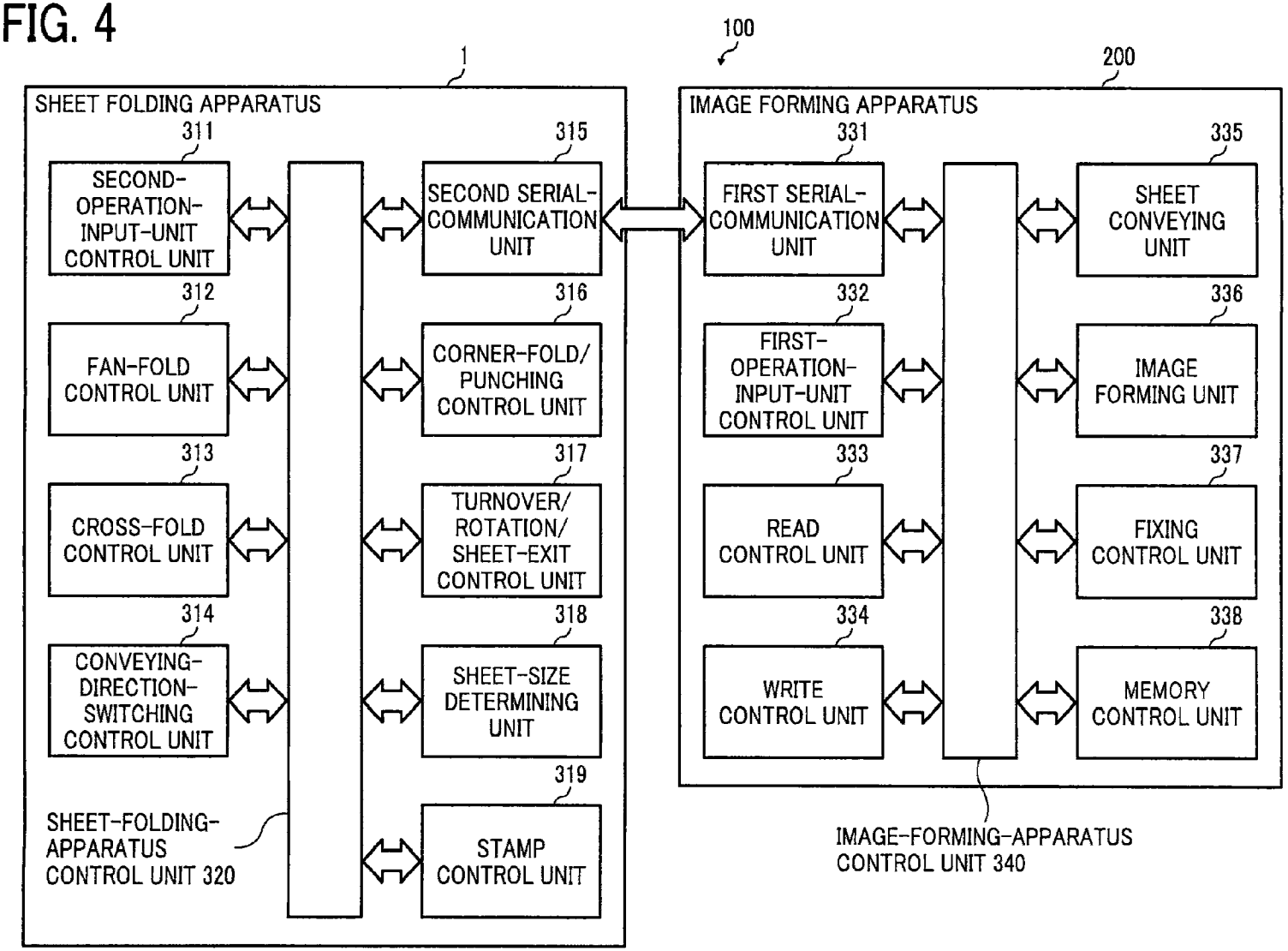
FIG. 4 is a block diagram of a system configuration of the image forming system depicted in FIG. 1.

Electrical configuration of the image forming system 100 will be schematically described with reference to FIG. 4. The image forming apparatus 200 includes a first serial-communication unit 331, a first-operation-input-unit control unit 332, a read control unit 333, a write control unit 334, a sheet conveying unit 335, an image forming unit 336, a fixing control unit 337, a memory control unit 338, and an image-forming-apparatus control unit 340.

The sheet folding apparatus 1 includes a second operation-input-unit control unit 311, a fan-fold control unit 312, a cross-fold control unit 313, a conveying-direction-switching control unit 314, a second serial-communication unit 315, a corner-fold/punching control unit 316, a turnover/rotation/sheet-exit control unit 317, a sheet-size determining unit 318, a stamp control unit 319, and a sheet-folding-apparatus control unit 320.

A serial cable 350 connects the first serial-communication unit 331 of the image forming apparatus 200 to the second serial-communication unit 315 of the sheet folding apparatus (post-processing apparatus) 1.

The sheet folding apparatus 1 exchanges information with the image forming apparatus 200 via the first serial-communication unit 331 and the second serial-communication unit 315. Examples of information sent from the image forming apparatus 200 to the sheet folding apparatus 1 include a sheet size, a fold pattern, whether ink stamping is to be performed, an ink stamping position, a margin size, values for adjusting folding width and length, and whether folding is to be performed. Examples of information sent from the sheet folding apparatus 1 to the image forming apparatus 200 include a signal indicative of occurrence of jam in the sheet folding apparatus 1, error-related data, and a fold count.

Operations in the online mode will be described below. In the online mode, a sheet of recording medium, onto which an image has been transferred in the image forming apparatus 200, is fed to the sheet folding apparatus 1 to be folded. A sheet size is selected or entered from a sheet-folding setting screen of the first operation input unit 220 of the image forming apparatus 200. Thereafter, one of fold types applicable to the selected sheet size is selected or entered. Other parameters can also be entered from the screen.

Figure 5:
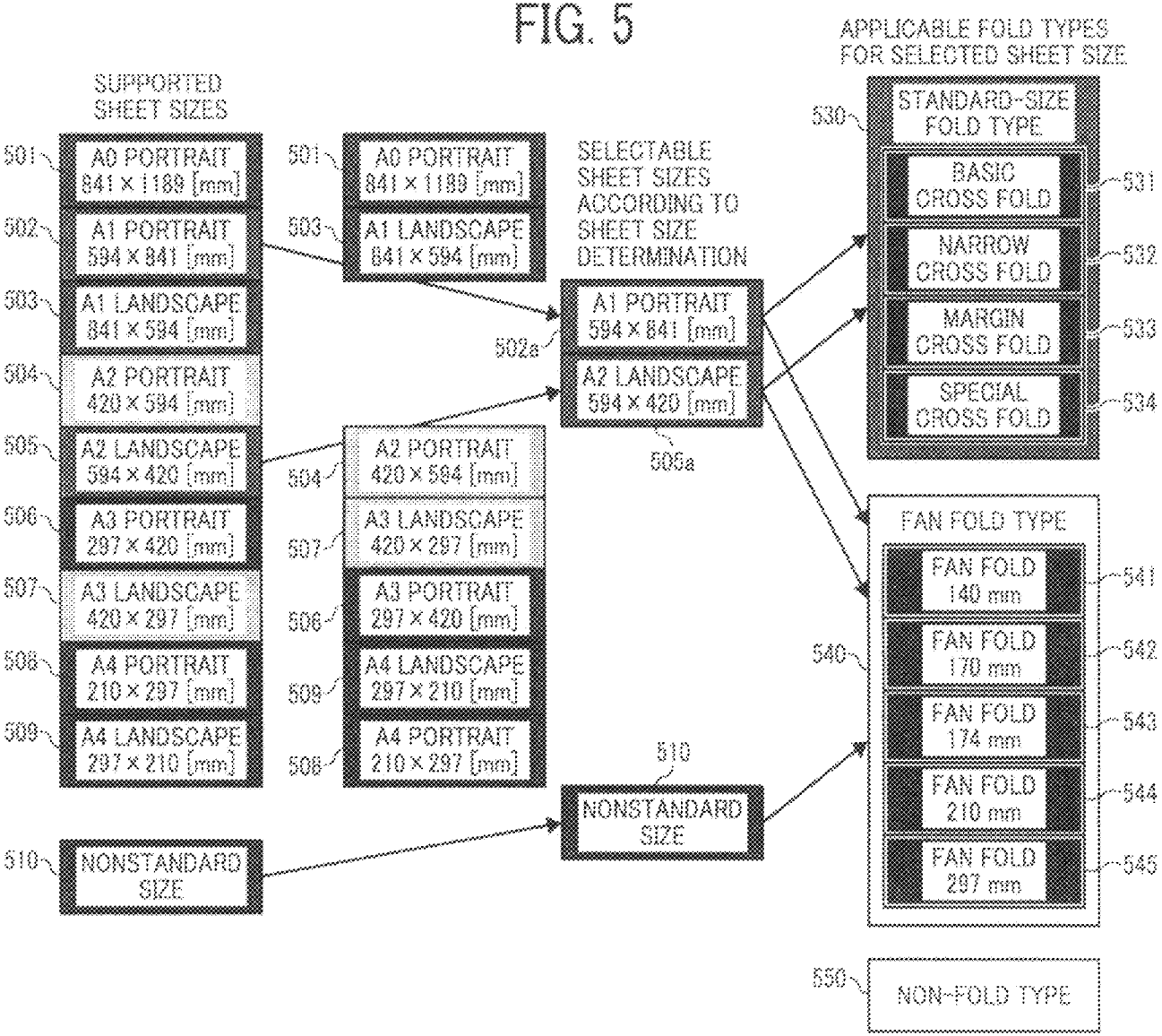
FIG. 5 is a schematic diagram for explaining a correspondence between sheet sizes supported by a sheet folding apparatus depicted in FIG. 1 and fold patterns applicable to the sheet sizes.

As depicted in FIG. 5, the sheet folding apparatus 1 supports a plurality of standard sheet sizes, such as A0 portrait (501), A1 portrait (502), A1 landscape (503), A2 portrait (504), A2 landscape (505), A3 portrait (506), A3 landscape (507), A4 portrait (508), and A4 landscape (509). Any one of a plurality of fold patterns, such as basic cross fold (531), narrow cross fold (532), margin cross fold (533), and special cross fold (534) is applicable to a sheet of any one of A0 portrait, A1 portrait, A1 landscape, A2 portrait, A2 landscape, A3 portrait, and A3 landscape. In these fold patterns, a sheet is fan folded along the first folds orthogonal to the sheet conveying direction. Some of the sheets are then further folded along at least one second fold orthogonal to the first folds. Whether the sheet is folded along the second fold depends on the sheet size. These cross fold patterns for standard size sheets are collectively referred to as "standard-size fold type (530)". In contrast, fold patterns, in which a sheet is folded into a fan-like shape but not folded along the second fold, are collectively referred to as "fan fold type (540)". Examples of the width of the fan-like shape include 140 millimeters (541), 170 millimeters (542), 174 millimeters (543), 210 millimeters (544), and 297 millimeters (545). In a fold pattern of the fan fold type, a sheet is folded into a fan-like shape but not folded along the second fold. Accordingly, the fan fold type is applicable to nonstandard size sheets. It is also possible to select "non-fold type (550)".

How the image forming apparatus 200 operates will be described below. The image forming apparatus 200 includes an image reading device 205 and a manual feed table 208. The manual feed table 208 is arranged at a position lower than that of the image reading device 205. A sheet P of recording medium placed on the manual feed table 208 is fed to the registration rollers 207. After being temporarily stopped by the registration rollers 207 for timing adjustment, the sheet P is fed to an image forming unit 206. In the image forming unit 206, a latent image is formed on the photosensitive element 222 based on image data. The latent image is developed with toner to form a toner image that is then fixed onto the sheet P by the fixing device 210. The sheet P onto which the toner image has been fixed is output to the sheet folding apparatus (post-processing apparatus) 1 by a pair of sheet output rollers 211.

Figure 2:
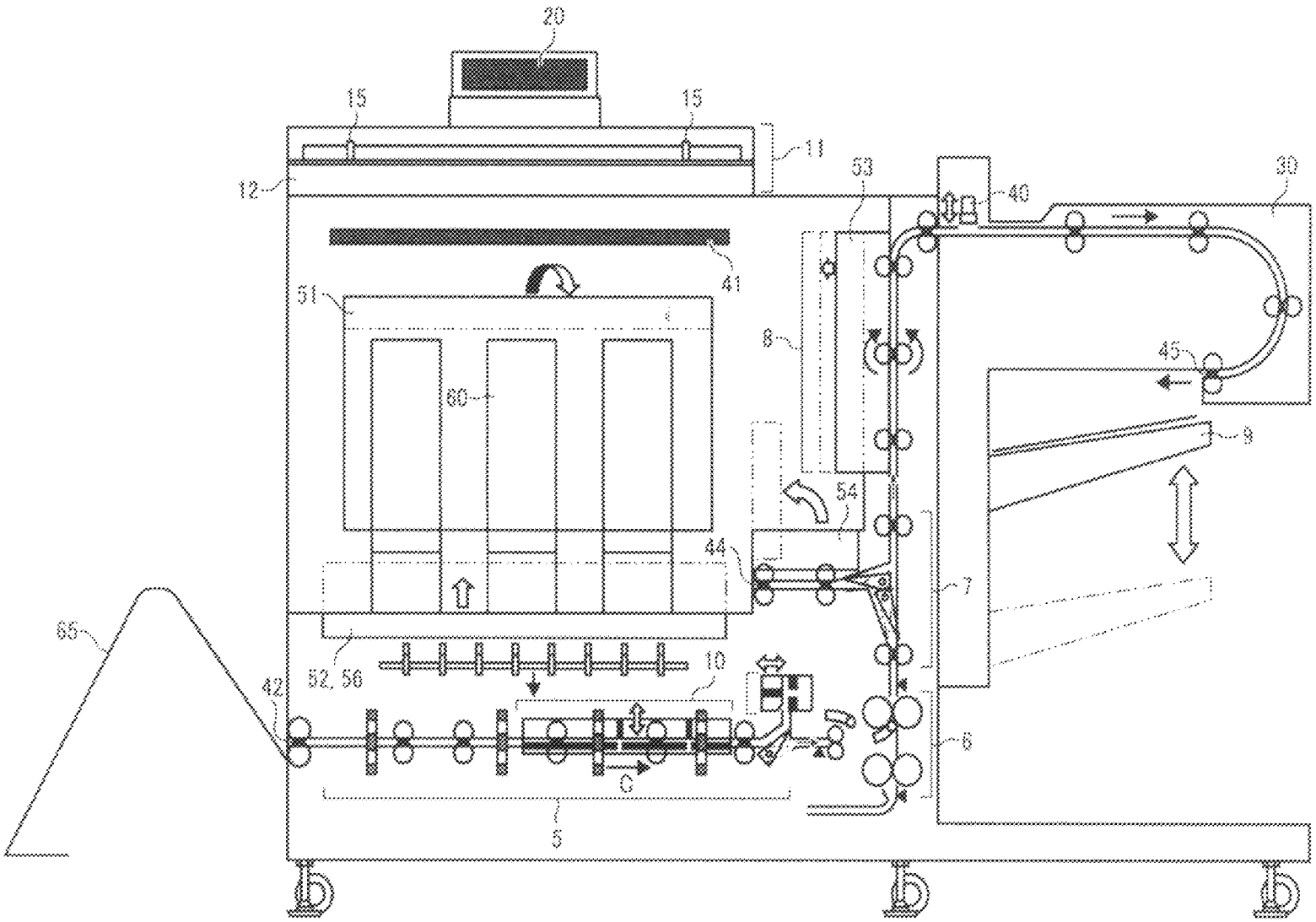
FIG. 2 is a schematic back view of the internal configuration of the image forming system of FIG. 1 when viewed from the side of arrows A-A.

When the sheet P is to be folded in a fold pattern of the standard-size fold type (530), as depicted in FIG. 1, the sheet P is fed to the sheet folding apparatus 1 by the sheet output rollers 211 via the connecting unit 2. Meanwhile, the path switching flap 21 is moved by a solenoid (not shown) to switch the sheet conveying path depending on whether the sheet P is to be folded. When the sheet P is to be subjected to corner fold, the solenoid moves the path switching flap 21 to guide the sheet P as indicated by a solid line in FIG. 1, thereby guiding the sheet P to the corner folding unit 3. The corner folding unit 3 folds a corner on the leading end of the sheet P while conveying the sheet P. The sheet P out of the corner folding unit 3 is conveyed to the fan folding unit 4 that folds the sheet P along the first folds, and then conveyed to the conveying-direction switching unit 5. As depicted in FIG. 2, the fan-folded sheet P is subjected to skew correction performed by the conveying-direction switching unit 5. After the sheet P receives punching if required, the sheet P is conveyed to the cross folding unit 6 in a direction indicated by an arrow C (hereinafter, "C direction"). The sheet P is fan folded along the second folds that extend orthogonal to the first folds by the cross folding unit 6 into an A4 size. In this example, the sheet P is folded into A4 size; however, the size into which the sheet P is folded is not limited to A4 size.

When a size of the sheet P is larger than a predetermined size, e.g., A0, the sheet P is not subjected to the folding operation performed by the cross folding unit (second folding unit) 6. This is because when a sheet larger than the predetermined size is folded into A4 size, the thickness of the folded sheet exceeds a maximum thickness that can be handled by the sheet folding apparatus 1.

The sheet P folded in a fold pattern into A4 size is turned over (upside down) by the turnover unit 7 so that an image surface of the sheet P faces downward on the tray 9. The sheet P is also rotated by any one of 90 degrees clockwise, 90 degrees counterclockwise, and 180 degrees by the rotation unit 8 on a fold-pattern-by-fold-pattern basis so that an image of every sheet is identically oriented on the tray 9. When ink stamping is to be performed on the folded sheet P, the image surface of the sheet P receives ink stamping from the stamp unit 40. The sheet P is then turned over to cause a stamped surface to face downward and delivered onto the tray 9.

When the sheet P is to be folded in a fold pattern of the fan fold type (540), as depicted in FIG. 1, the sheet P is fed to the sheet folding apparatus 1 by the sheet output rollers 211 via the connecting unit 2. When the sheet P is to be subjected to corner fold, the solenoid moves the path switching flap 21 to guide the sheet P as indicated by the solid line in FIG. 1, thereby guiding the sheet P to the corner folding unit 3. The corner folding unit 3 folds a corner on the leading end of the sheet P while conveying the sheet P. The sheet P out of the corner folding unit 3 is conveyed to the fan folding unit 4 that folds the sheet P along the first folds, and then conveyed to the conveying-direction switching unit 5. As depicted in FIG. 2, the sheet P is subjected to skew correction performed by the conveying-direction switching unit 5. The sheet P is then delivered to a second exit 42 of the turnover-and-delivery unit 18 in a direction indicated by an arrow C' (hereinafter, "C' direction") of FIG. 3. The sheet P output from the second exit 42 is placed on the external tray 65 formed of wire. The shape of the external tray 65 is not limited to that depicted in FIG. 2.

When, in place the external tray 65, the turnover-and-delivery unit (turnover unit) 18 that has the fifth exit (exit) 43 is attached to the second exit 42, the sheet P is output through the second exit (inlet) 42 through the turnover-and-delivery unit 18 to be stacked in the stacker unit 71. The stacker unit 71 is arranged above the top surface 70 of the conveying-direction switching unit 5.

In this manner, any one of the external tray 65 and the turnover-and-delivery unit 18 can be attached to the second exit 42 as required.

A fold count is determined by the sheet size and the fold width. For example, an A0 sheet is folded six or seven times; an A1 sheet is folded four or five times; and an A2 sheet is folded three or five times.

A standard-size sheet is output through the fourth exit (third exit) 44 while a nonstandard-size sheet is output through the fifth exit 43.

When the non-fold type (550) is selected, the sheet P is fed to the sheet folding apparatus 1 by the sheet output rollers 211 via the connecting unit 2. The solenoid moves the path switching flap 21 to guide the sheet as indicated by a dotted line in FIG. 1, thereby guiding the sheet P to the non-fold sheet exit (first exit) 41. As depicted in FIGS. 1 and 2, the sheet P is output with its leading end directed downward so that the sheet P is turned over. The sheet P is then laid and stacked on the stacker set 60 that substantially has the shape of the inverted alphabet V in the stacker unit 71. The stacker set 60 is formed of wire.

Meanwhile, each of the conveying-direction switching unit 5, the turnover unit 7, and the rotation unit 8 is arranged in a casing. A jammed sheet in the conveying-direction switching unit 5 can be removed by opening a cover door 51, a cover door 52, or a cover door 56, that in the turnover unit 7 can be removed by opening a cover door 54, and that in the rotation unit 8 can be removed by opening a cover door 53. The configurations of the cover doors 51 to 54 and 56 according to the first embodiment will be described below. When paper jam of a sheet of which leading end is at any position on the sheet conveying path from the path switching flap 21 to an entrance of the fan folding unit 4 via the corner folding unit 3 occurs, the cover door 51 is pulled open to remove the jammed sheet. More specifically, the cover door 51 is pulled open in a space above the conveying-direction switching unit 5 as indicated by an open arrow to a position indicated by a dotted line in FIG. 1.

When paper jam of a sheet of which leading end is upstream of the fan folding unit 4 occurs, the cover door 56 is pulled open to remove the jammed sheet. More specifically the cover door 56 is pulled open in the space above the conveying-direction switching unit 5 as indicated by a curved open arrow to a position indicated by a dotted line in FIG. 1. Meanwhile, the stacker set 60 includes a rear end 61 and a pivot 62. The rear end 61 is placed on a top portion of the cover door 56 to be rotatable about the pivot 62. When the cover door 56 is opened as indicated by the curved open arrow, the rear end 61 of the stacker set 60 is rotated as indicated by a largest open arrow in FIG. 1, thereby moving the rear end 61 to a position indicated by a dotted line. Hence, the rear end 61 is prevented from interfering with the cover door 56.

When paper jam of a sheet of which leading end is in the conveying-direction switching unit 5 occurs, the cover door 52 is pulled open to remove the jammed sheet. More specifically the cover door 52 is pulled open in the space above the conveying-direction switching unit 5 as indicated by a second largest open arrow to a position indicated by a dotted line in FIG. 1.

When paper jam of a sheet of which leading end is in the turnover unit 7 occurs, the cover door 54 is pulled open to remove the jammed sheet. More specifically the cover door 54 is pulled open in the space above the conveying-direction switching unit 5 as indicated by a curved open arrow to a position indicated by a dotted line in FIG. 2.

When paper jam of a sheet of which leading end is in the rotation unit 8 occurs, the cover door 53 is pulled open to remove the jammed sheet. More specifically the cover door 53 is pulled open in the space above the conveying-direction switching unit 5 as indicated by a curved open arrow to a position indicated by a dotted line in FIG. 2.

In short, each of the cover doors 51 to 54 and 56 is to be pulled open into the space in the stacker unit 71.

According to the first embodiment, the stacker unit 71 has the first exit 41 through which a non-folded sheet is to be output and the fourth exit 44 and the fifth exit 43 through which a folded sheet is to be output. Put another way, the stacker unit 71 is used for stacking both the non-folded sheets and the folded sheets. Accordingly, because it is not necessary for the sheet folding apparatus 1 include a stacker unit for each of non-folded sheets and folded sheets, the sheet folding apparatus 1 can be constructed compact.

The stacker unit 71 is arranged above the conveying-direction switching unit 5. Because this arrangement requires a smaller space than an arrangement in which the stacker unit 71 is arranged on a side of the sheet folding apparatus 1, the sheet folding apparatus 1 can be constructed further compact.

The conveying-direction switching unit 5 is capable of conveying the sheet P in any one of the C direction and the C' direction that are opposite to each other. The stacker unit 71 has the fifth exit 43, through which a sheet having been folded by the fan folding unit (first folding unit) 4 can be output by being conveyed in the C' direction away from the cross folding unit (second folding unit) 6. Hence, not only the cross-folded sheet but also a fan-folded sheet having been folded only along the first folds can be stacked in the stacker unit 71. This makes it possible to construct the sheet folding apparatus 1 compact.

The cover doors 51 to 54 and 56 for maintenance use are to be pulled open into the space in the stacker unit 71. Utilizing the space in the stacker unit 71 in this manner eliminates the need of additional space for opening the cover doors 51 to 54 and 56. Hence, it is possible to construct the sheet folding apparatus 1 compact.

The stacker unit 71 includes the stacker set 60 that substantially has the shape of the inverted alphabet V to cause a sheet out of the first exit 41 to be laid thereon. By arranging a portion of the stacker set 60 in the space of the stacker unit 71 such that the stacker set 60 can rotate, even when the cover door 56 of the conveying-direction switching unit 5 is opened, the stacker set 60 is prevented from interfering with the cover door 56. Hence, it is possible to construct the sheet folding apparatus 1 compact.

The conveying-direction switching unit 5 is capable of conveying the sheet P in any one of the C direction and the C' direction that are opposite to each other. By being conveyed in the C' direction away from the cross folding unit (second folding unit) 6, a sheet having been folded by the fan folding unit (first folding unit) 4 is output through the second exit 42. Hence, a fan-folded sheet that is folded only along the first folds can be efficiently output with a simple configuration.

Other embodiments of the present invention will be described below. Note that components and portions of the other embodiments that provide the same effect as that provided by the first embodiment will be denoted by the same reference numerals to omit specific description thereof. In the following description, components and portions that substantially differ from those of the first embodiment will be mainly described.

A second embodiment of the present invention will be described below. The second embodiment differs from the first embodiment in that when a fold count of the sheet P folded in a fold pattern of the fan fold type (540) of FIG. 5 is relatively small, the fan-folded sheet P is fed to the conveying-direction switching unit 5 and subjected to skew correction. After the fan-folded sheet P is punched as required, the fan-folded sheet P is conveyed to the cross folding unit 6 in the C direction of FIG. 2. The fan-folded sheet P is then conveyed from the cross folding unit 6 to the turnover unit 7 that turns over the sheet P. The turned-over sheet P is output through the fourth exit 44 to be stacked on the top surface (placement portion) 70 of the conveying-direction switching unit 5 of the stacker unit 71. The placement portion 70 is arranged above the conveying-direction switching unit 5.

The relatively small fold count (hereinafter, "predetermined fold count") can be set arbitrarily to, e.g., four times. When a fold count selected or entered for a sheet is equal to or smaller than the predetermined fold count, the sheet P is fed to the cross folding unit 6. In contrast, when the fold count is greater than the predetermined fold count, the sheet is conveyed in the C' direction of FIG. 3 in the conveying-direction switching unit 5. The sheet P is then output through the fifth exit 43 of the turnover-and-delivery unit 18 and stacked on the placement portion 70 of the stacker unit 71.

The second embodiment produces the following effect, in addition the same effect as that provided by the first embodiment. In the second embodiment, a sheet of which fold count is larger than that of a sheet to be output through the fourth exit 44 is output through the fifth exit 43. Accordingly, a folded sheet having a relatively large thickness due to a relatively high fold count is output to the stacker unit 71 by way of a relatively simple conveying path from the conveying-direction switching unit 5 without passing through the cross folding unit 6 and the turnover unit 7. This arrangement advantageously reduces frequency of paper jam or the like.

Figure 6:
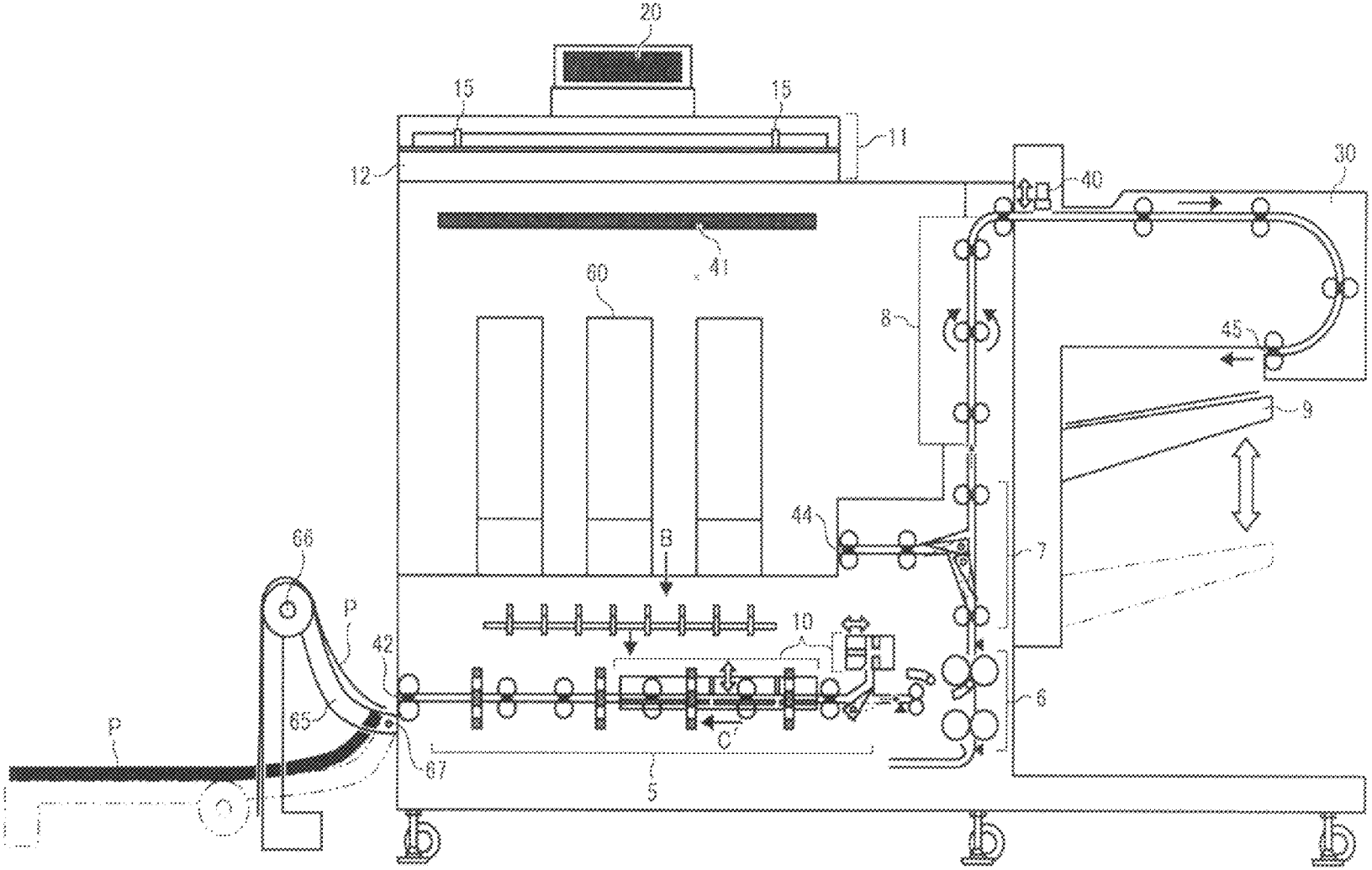
FIG. 6 is a schematic back view of an internal configuration of an image forming system according to a third embodiment of the present invention.

A third embodiment of the present invention will be described with reference to FIGS. 1 and 6. FIG. 6 is a schematic cross-sectional view depicting the configuration of an image forming system according to the third embodiment taken along the line A-A of FIG. 1. The third embodiment differs from the first embodiment in using the second exit 42 as an exit and not including the turnover-and-delivery unit 18. The external stacker (folded sheet tray) 65 is arranged at the second exit 42. The sheet P having been folded in a fold pattern of the fan fold type (540) is to be stacked on the external tray 65. The external tray 65 can be switched between an inverted alphabet V state indicated by a solid line in FIG. 6 and a horizontally straightened state indicated by a dotted line.

When the external tray 65 is in the inverted alphabet V state, the number of sheets that can be stacked on the external tray 65 is disadvantageously small; however, a footprint required for the external tray 65 is advantageously small. In contrast, when the external tray 65 is in the horizontally straightened state, the number of sheets that can be stacked on the external tray 65 is advantageously large; however, the footprint required for the external tray 65 is disadvantageously large relative to that for the inverted alphabet V shape.

As depicted in FIG. 6, the fan-folded sheet P is delivered to the conveying-direction switching unit 5 and then conveyed in the C' direction to the second exit 42 to be stacked on the external tray 65.

According to the third embodiment, because the external tray (folded sheet tray) 65 can be flexibly bent at a center portion in the C' direction, the external tray 65 can be switched between the inverted alphabet V state and the horizontally straightened state. Hence, by bending the external tray 65 into the inverted alphabet V state, it is possible to stack folded sheets on the external tray 65 relatively compact.

It is also possible to cause, as in the case of the second embodiment, a sheet of which fold count is larger than that of a sheet to be output through the fourth exit 44 is output through the second exit 42 in the third embodiment. In this case, as in the second embodiment, a folded sheet having a relatively large thickness due to a relatively high fold count is output to the stacker unit 71 by way of the relatively simple conveying path from the conveying-direction switching unit 5 without passing through the cross folding unit 6 and the turnover unit 7. This arrangement advantageously reduces frequency of paper jam or the like.

The present invention is not limited to the specific details and representative embodiments shown and described herein. Accordingly, various modifications may be made without departing from the spirit or scope of the general inventive concept as defined by the appended claims and their equivalents.

For example, a sheet folding apparatus according to an aspect of the present invention is not necessarily connected to an image forming apparatus. The invention can be applied to an independent sheet folding apparatus that folds sheets fed to the sheet folding apparatus continuously.

According to an aspect of the present invention, it is unnecessary to provide a stacker unit for each of non-folded sheets and folded sheets. Accordingly, it is possible to construct a sheet folding apparatus compact.

Because a stacker unit is arranged in the sheet folding apparatus, the sheet folding apparatus requires a smaller footprint than a sheet folding apparatus whose stacker unit is arranged on a side of the sheet folding apparatus. Hence, it is possible to construct the sheet folding further compact.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet folding apparatus for use in folding a sheet of recording medium, the sheet folding apparatus comprising:

a first folding unit configured to fold a sheet along at least one first fold that extends orthogonal to a direction of conveyance of the sheet;

a second folding unit configured to fold a sheet along at least one second fold that extends orthogonal to the first fold;

a first exit configured to output a sheet having not been folded by any one of the first folding unit and the second folding unit;

a second exit configured to output a sheet folded by the first folding unit;

a third exit configured to output a sheet folded by the first folding unit and the second folding unit;

a folded-sheet conveying unit configured to convey a sheet folded by the first folding unit to the second folding unit; and a first stacker unit in which sheets are to be stacked, the first stacker unit being arranged above the folded-sheet conveying unit, wherein the sheet output from the first exit is stacked in the first stacker unit.

2. The sheet folding apparatus according to claim 1, wherein the first stacker unit substantially has a shape of an inverted alphabet V, and the sheet output from the first exit is laid along the shape of the inverted alphabet V of the first stacker unit in an orientation in which a leading end of the sheet is near the first exit and a trailing end of the sheet is away from the first exit so that the sheet is turned upside down and then stacked in the first stacker unit.

3. The sheet folding apparatus according to claim 2, wherein a portion of the first stacker unit is arranged in the space in the first stacker unit to be rotatable, and when a cover door of the conveying-unit casing is opened, the portion is rotated to prevent the first stacker unit from interfering with the cover door of the conveying-unit casing.

4. The sheet folding apparatus according to claim 3, further comprising a turnover-and-delivery unit that turns over the sheet, the turnover-and-delivery unit being arranged at the second exit, wherein the turnover-and-delivery unit has another exit, through which the sheet turned over by the turnover-and-delivery unit is to be output, and the sheet output from the another exit is to be stacked in a second stacker unit.

5. The sheet folding apparatus according to claim 1, further comprising:

a second stacker unit arranged above the folded-sheet conveying unit; and a fourth exit, wherein the folded-sheet conveying unit includes a reversing unit, the reversing unit reversing a sheet conveying direction of the sheet folded by the first folding unit, and the sheet of which conveying direction is reversed by the reversing unit is output through the fourth exit and stacked in the second stacker unit.

6. The sheet folding apparatus according to claim 1, wherein when a size of the sheet is larger than a predetermined size, the sheet is inhibited from being folded by the second folding unit.

7. The sheet folding apparatus according to claim 1, further comprising:

a turnover unit that turns over the sheet folded by the second folding unit, the turnover unit being provided in a turnover-unit casing; and a rotation unit that rotates the sheet by any one of 90 degrees clockwise, 180 degrees, and 90 degrees counterclockwise, the rotation unit being arranged downstream of the second folding unit in the sheet conveying direction and provided in a rotation-unit casing, wherein the folded-sheet conveying unit is provided in a conveying-unit casing, at least one of the conveying-unit casing, the turnover-unit casing, and the rotation-unit casing includes a cover door that is opened to expose a corresponding one of the folded-sheet conveying unit, the turnover unit, and the rotation unit, and the cover door is to be pulled open into a space in the first stacker unit.

8. The sheet folding apparatus according to claim 1, wherein the folded-sheet conveying unit is capable of conveying the sheet in any one of a first direction toward the second folding unit and a second direction away from the second folding unit, and the folded-sheet conveying unit has the second exit, through which the sheet folded by the first folding unit is output by being conveyed in the second direction.

9. The sheet folding apparatus according to claim 8, wherein an external tray, on which the sheet output from the second exit is to be stacked, is arranged at the second exit, the external tray having a shape of an inverted alphabet V along which the sheet is to be laid and stacked.

10. The sheet folding apparatus according to claim 9, wherein the external tray is flexibly bendable at a center portion in the second direction, and the external tray is switchable between a bent state in which the external tray is bent at the center portion and a straightened state.

11. An image forming system comprising an image forming apparatus configured to form an image on a sheet of recording medium; and a sheet folding apparatus configured to receive the sheet and fold the sheet, the sheet folding apparatus including a first folding unit configured to fold a sheet along at least one first fold that extends orthogonal to a direction of conveyance of the sheet;

a second folding unit configured to fold a sheet along at least one second fold that extends orthogonal to the first fold;

a first exit configured to output a sheet having not been folded by any one of the first folding unit and the second folding unit;

a second exit configured to output a sheet folded by the first folding unit;

a third exit configured to output a sheet folded by the first folding unit and the second folding unit;

a folded-sheet conveying unit configured to convey a sheet folded by the first folding unit to the second folding unit; and a first stacker unit in which sheets are to be stacked, the first stacker unit being arranged above the folded-sheet conveying unit, wherein the sheet output from the first exit is stacked in the first stacker unit.

* * * * *